US008970116B2

(12) United States Patent
Flaherty

(10) Patent No.: US 8,970,116 B2
(45) Date of Patent: Mar. 3, 2015

(54) PHOTO CONTROLLER, A PHOTO CONTROLLER ASSEMBLY AND A PROCESS OF CONTROLLING NON-UNITY POWER FACTOR DEVICES

(75) Inventor: Richard Charles Flaherty, Fuquay-Varina, NC (US)

(73) Assignee: Tyco Eletronics Corporation, Berwyn, PA (US)

( * ) Notice: Subject to any disclaimer, the term of this patent is extended or adjusted under 35 U.S.C. 154(b) by 587 days.

(21) Appl. No.: 13/188,082

(22) Filed: Jul. 21, 2011

(65) Prior Publication Data

US 2013/0020950 A1 Jan. 24, 2013

(51) Int. Cl.
*H05B 37/02* (2006.01)

(52) U.S. Cl.
CPC ..... *H05B 37/0227* (2013.01)
USPC ..... 315/159; 315/209 M; 315/360

(58) Field of Classification Search
USPC ..... 315/149, 150, 159, 209 M, 360
See application file for complete search history.

(56) References Cited

U.S. PATENT DOCUMENTS 7,016,802 B2 * 3/2006 Flaherty ..... 702/117
7,429,832 B2 * 9/2008 Foo ..... 315/291
8,310,163 B2 * 11/2012 Chen ..... 315/159
2002/0182905 A1 * 12/2002 Hedrick et al. ..... 439/105
2009/0134320 A1 5/2009 Flaherty
2012/0274238 A1 * 11/2012 Shah et al. ..... 315/297

OTHER PUBLICATIONS

Microchip, PIC10F200/202/204/206 Data Sheet, 2007 Microchip Technology, Inc.
www.cliftonlaboratories.com/compact_fl.htm, downloaded Jul. 6, 2011.
www.bristolwatch.com/ele/pd.html, Using a CdS Photoresistor, downloaded May 9, 2011.
en.wikipedia.org/wiki/TRIAC, downloaded May 9, 2011.
ST BTA06 and BTB06 Series 6A TRIACs Data Sheet, Feb. 2006, Rev. 6, ST Microelectronics 2006.
www.hardwareandtools.com/Area-Lighting-TYCO-CPG1-ALR-PL-120S-150-Watt Screw, downloaded Jun. 2, 2011.
energy.tycoelectronics.com/images/products/screwandpluga.jpg, downloaded May 9, 2011.

* cited by examiner

*Primary Examiner* — Thuy Vinh Tran

(57) ABSTRACT

Disclosed is a photo controller, a photo controller assembly, and a process for controlling non-unity power factor devices. The photo controller includes a housing and a circuit board positioned within the housing. The circuit board includes a photosensor, an electronic controller, and a thyristor secured to the circuit board. The electronic controller is configured to produce a series of trigger pulses for activating the thyristor; wherein the thyristor is configured to control power switching of a non-unity power factor lamp.

20 Claims, 6 Drawing Sheets

PHOTO CONTROLLER, A PHOTO CONTROLLER ASSEMBLY AND A PROCESS OF CONTROLLING NON-UNITY POWER FACTOR DEVICES

FIELD OF THE INVENTION

The present invention is directed to photo controllers and photo controller assemblies, and more specifically to photo controllers for controlling non-unity power factor devices.

BACKGROUND OF THE INVENTION

Incandescent lamps are unity power factor devices where the current is proportional to instantaneous line voltage, and line current is always present, except at zero cross points. The zero cross points are the points on the voltage wave where the line voltage is zero. Solid state relays, such as AC thyristor switches, are useful for controlling large AC power flows with milliampere-scale control circuits. AC thyristors can be used with incandescent lamps because there is always enough current to keep the switches from turning off except at the zero cross over of the line voltage. A trigger pulse of current applied shortly after the zero cross over will turn the thyristor on again for powering incandescent lamps.

Newer high-efficiency lamps, such as compact fluorescent and LED lamps, consume electricity differently from traditional incandescent lamps, drawing their currents in short erratic bursts (non-linear loading) rather than smoothly (linear loading). Most non-incandescent lamps include an electronic ballast which uses an alternating current to direct current converter circuit which interrupts the current through its switching action. These types of circuits normally only conduct the line current for a brief time within the instantaneous line voltage maximum and minimum peaks. Non-linear loads change the shape of the current waveform from a sine wave to some other distorted form, creating harmonic currents in addition to the original (fundamental frequency) AC current. These harmonic waveforms are a distortion of the current waveform, and change the phase relationship between the voltage and the current. Thus, as non-incandescent lamps can have their voltage and current waveforms out of phase, they are difficult to control using AC thyristor switches.

For most non-incandescent lamps, the distortion of the current waveform causes there to be no line current available shortly after the zero cross over of the line voltage, resulting in the AC thyristor not activating. One solution is to design a delay of the trigger pulse until current is present for a specific non-incandescent lamp waveform. While the trigger pulse can be controlled to delay until a point where current is present in the harmonic waveform, different non-incandescent lamps can have different phase angle relationships between the voltage and the current, where they start conducting current, thus necessitating a variety of trigger delay points.

Non-incandescent lamps can be controlled by photosensitive devices, such as photodiodes, phototransistors, and photodarlington light sensors. However, light given off by the controlled lamp can be reflected off nearby objects, causing the lamp to oscillate on and off. Compact fluorescent and LED lamps, unlike incandescent lamps, emit very little light in the infrared spectrum. Sunlight, conversely, contains a large amount of infrared light. Photosensitive devices with an infrared filter are useful to conduct only the infrared wavelength light.

A photo controller, a photo controller assembly, and a process for controlling a non-unity power factor device not suffering from one or more of the above drawbacks would be desirable in the art.

BRIEF DESCRIPTION OF THE INVENTION

In an exemplary embodiment, a photo controller includes a housing and a circuit board positioned within the housing. The circuit board includes a photosensor, an electronic controller and a thyristor secured to the circuit board. The electronic controller is configured to produce a series of trigger pulses for activating the thyristor, and the thyristor is configured to control power switching of a non-unity power factor lamp.

In another exemplary embodiment, a photo controller assembly includes a fixture socket, a non-unity power factor lamp, and a photo controller configured to releasably engage the fixture socket and the non-unity power factor lamp. The photo controller includes a housing and a circuit board positioned within the housing. The circuit board includes a photosensor, an electronic controller and a thyristor secured to the circuit board. The electronic controller is configured to produce a series of trigger pulses for activating the thyristor, and the thyristor is configured to control power switching of the non-unity power factor lamp.

In another exemplary embodiment, a process for controlling a non-unity power factor lamp includes providing a photo controller including an AC thyristor, producing a repeating series of trigger pulses sent to the AC thyristor upon a signal dropping below a setpoint.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary photo controller, a photo controller assembly, and a process for controlling non-unity power factor devices. Embodiments of the present disclosure permit a photo controller to include a light sensor which responds to the level of infrared light and does not respond to visible light, permits use of an AC thyristor as a switching device for non-unity power factor lamps, permits triggering of the AC thyristor by multiple pulses of limited duration during each half line cycle of voltage, permits a greater variety of non-unity power factor lamps to be connected, and combinations thereof.

Figure 1:
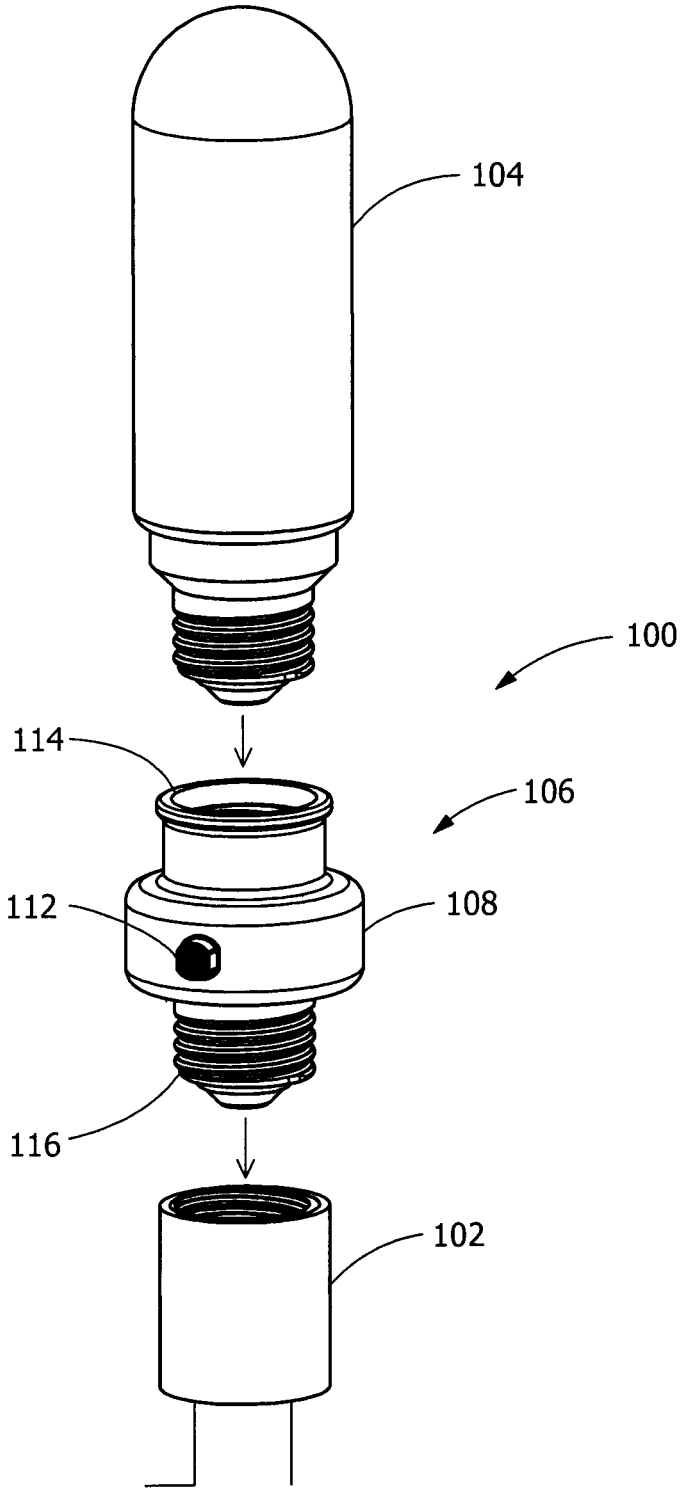
FIG. 1 is an exploded perspective view of an exemplary photo controller assembly according to an embodiment of the present invention.

Referring to FIG. 1, in one embodiment, an exemplary photo controller assembly 100 includes a fixture socket 102 in electrical communication with a lamp 104, and a photo controller 106 configured to releasably engage the fixture socket 102 and the lamp 104. In one embodiment, the lamp 104 is a device that converts electrical energy to light and may have a non unity power factor (with distorted current waveform), such as compact fluorescent or LED light bulbs, for example. In one embodiment, the photo controller 106 is configured for indoor or outdoor applications and has a compact design that easily engages most table lamp or outdoor post lantern type fixtures.

The photo controller 106 includes a housing 108, and the housing 108 is any suitable housing structure capable of structural and electrical connection to the lamp 104 and the fixture socket 102. In one embodiment, the housing 108 is fabricated of polymeric or other durable material, such as polycarbonate (PC) or polypropylene (PP), or combinations thereof. The housing 108 is any suitable geometry, for example, cylindrical, cuboid, frustoconical, or combinations thereof.

The housing 108 includes a light transmitting port 112, a lamp socket 114 and a lamp adaptor 116. The light transmitting port 112 allows sunlight or ambient light to enter the housing 108 for control of lamp 104. The lamp socket 114 is configured for making an electrical and structural connection to a base of the lamp 104, the base being a threaded Edison screw base, for example. The lamp adaptor 116 is configured for making an electrical and structural connection to the fixture socket 102, the lamp adaptor 116 being a threaded Edison screw base, for example. The fixture socket 102 is electrically connected to an AC power source (not shown).

Figure 2:
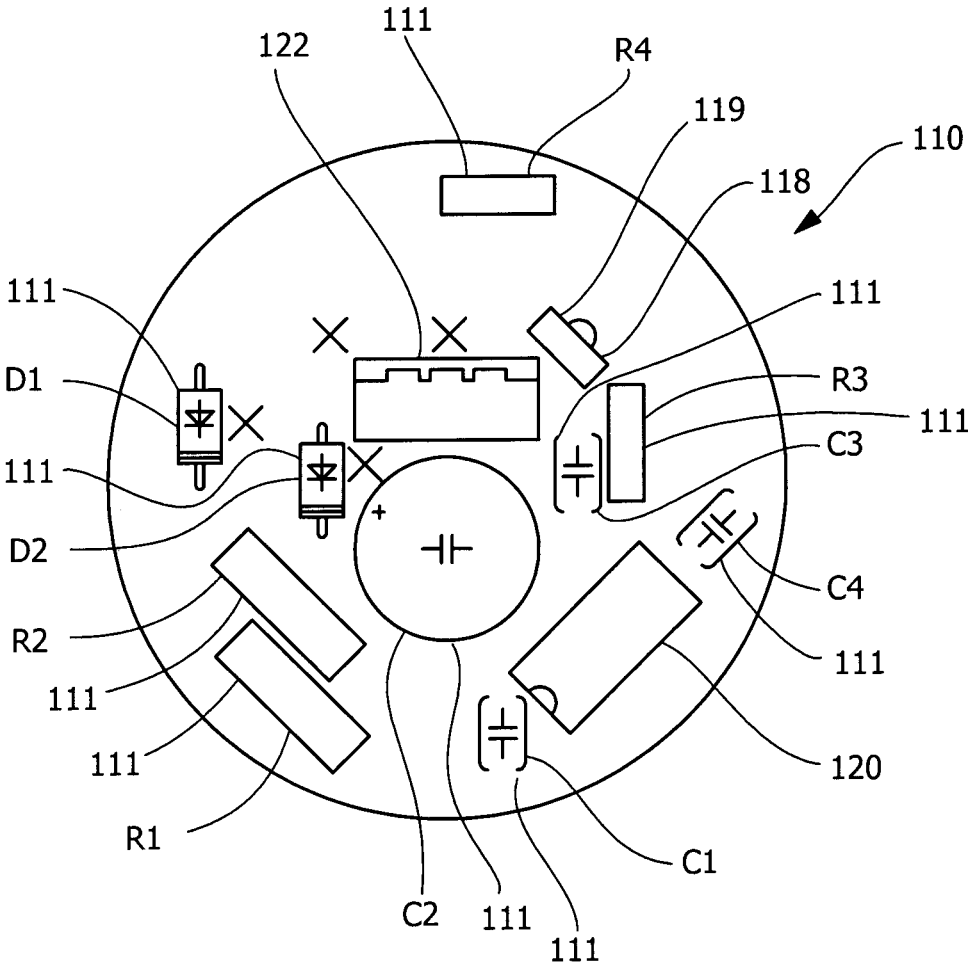
FIG. 2 is a plan view of a schematic layout of a circuit board in an exemplary photo controller assembly according to an embodiment of the present invention.

The housing 108 substantially encloses a circuit board 110 (see FIG. 2), and protects it from exposure to the environment. Referring to FIG. 2, in one embodiment, the circuit board 110 includes a photosensor 118, an electronic controller 120 and an AC thyristor 122 secured to the circuit board 110. The circuit board 110 includes any suitable electronic components 111, such as diodes (D1-D2), capacitors (C1-C4) and resistors (R1-R4), for example, used to provide a DC power supply to the photosensor 118 and to the electronic controller 120, and to filter and regulate the trigger pulse sent to the AC thyristor 122. The circuit board 110 electronic components take the AC voltage of a power line (not shown) and convert it to a DC voltage which is used to power the electronic controller 120 and the photosensor 118.

In one embodiment, the photosensor 118 is a light sensor, such as a photodiode, phototransistor, or photodarlington, for example, that is sensitive to infrared light. In one embodiment, the photosensor 118 is a phototransistor rated for maximum collector emitter breakdown voltage of 30V, maximum collector current of 4.8 mA, maximum dark current of 100 nA, a viewing angle of 20 degrees, and maximum power of 100 mW. In one embodiment, the photosensor 118 includes a visible light blocking filter or coating 119 that makes it only sensitive to light of a predetermined wavelength. In one embodiment, the predetermined wavelength is an "infrared" or "IR" wavelength within the range of about 700 nanometers to about 1 millimeter, in the range of IR-A, IR-B or IR-C, or combinations thereof. The terms "near infrared" or "IR-A" refer to energy having a wavelength within the range of about 700 nanometers to about 1400 nanometers. The term "IR-B" refers to energy having a wavelength within the range of about 1400 nanometers to about 3000 nanometers. The terms "far infrared" or "IR-C" refer to energy having a wavelength within the range of about 3000 nanometers to about 1 millimeter. In another embodiment, the light of a predetermined wavelength is in the range of IR-A, or about 940 nanometers. The filter or coating blocks visible light and permits light of the predetermined wavelength to pass through. The coating is implemented by adding visible light absorbing pigments to the encapsulation of a photodiode, phototransistor, or photodarlington, for example. In one embodiment, the coating pigments or ink are applied to the encapsulation by printing methods such as dipping, spraying, inkjet, silk screen, impression, rubber stamping, brushing, or penning, for example.

In one embodiment, the AC thyristor 122 is configured to control power switching of the lamp 104. In one embodiment, the lamp 104 is a non-unity power factor lamp, for example. The AC thyristor 122 is an electronic power switch which conducts current in either direction when it is triggered by applying a small current of either polarity between the gate and one of the two main terminals. An AC thyristor is also formally known as a bidirectional triode thyristor or bilateral triode thyristor. The conduction operation of the AC thyristor 122 makes the device useful for controlling large AC power flows with milliampere-scale control circuits. Once the AC thyristor 122 is triggered, it continues to conduct current until the level drops below a certain threshold value, or holding current, such as occurs at the end of a half-cycle of AC mains power, at which point the AC thyristor 122 turns off. For most non-incandescent lamps, the distortion of the current waveform causes there to be no line current available shortly after the zero cross over of the line voltage (see FIG. 6), which causes deactivation of the AC thyristor. Application of repetitive trigger pulses overcomes the lack of current and reactivates the AC thyristor. Different non-incandescent lamps can have different phase angle relationships between the voltage and the current, resulting in various points where they start conducting current. To address this, a series of repetitive trigger pulses are applied to activate the AC thyristor 122.

In one embodiment, the AC thyristor 122 does not require extra circuitry to prevent premature or false triggering. The AC thyristor 122 is rated for off state voltage of 600V, maximum hold and gate trigger current of 35 mA, non repetitive surge peak on-state current of 60 A at 50 Hz and 63 A at 60 Hz, maximum on state current of 6 A, and maximum gate trigger voltage of 1.3V.

The electronic controller 120 is an electronic circuit or microcontroller, for example, that receives the analog electrical signal produced by the photosensor 118, and responds by determining whether it is day or night, or determining if a predetermined setpoint for activation of the lamp has been reached. If the photosensor 118 determines that it is night, the electronic controller 120 will provide a series of trigger pulses to the AC thyristor 122 to cause the AC thyristor 122 to switch on the lamp 104. In one embodiment, an activation period is the period of time when the lamp 104 should be powered as determined by the electronic controller. The trigger pulses are applied continuously during the activation period. In one embodiment, microcontrollers, which offer more flexibility than traditional analog controllers, are used with the AC thyristor 122 for control of lamps by producing a series of trigger pulses applied repetitively during the activation period to activate the AC thyristor switch 122 at the moment the resulting lamp current is non-zero. In order for the electronic controller 120 to work with all non-incandescent lamp types, it continuously produces short duration trigger pulses during the activation period.

In one embodiment, the electronic controller 120 is an 8 bit flash microcontroller with processor rated for 4 MHz operating speed, four input/output pins, program memory of 384B (256×12) flash, RAM size of 16×8, supply voltage of 2V to 5.5V, operating temperature of minus 40° C. to 85° C., and includes an internal oscillator, power-on reset and watchdog timer. In one embodiment, trigger pulses are applied by the electronic controller 120 to the AC thyristor switch 122 trigger terminal every 100 microseconds during the activation period when the electronic controller 120 determines that the light level signal is below the predetermined set point for activation. The trigger pulses are applied continuously by the electronic controller 120 during the activation period, and the trigger pulses are not applied in synchronism with the line voltage.

In one embodiment, the photo controller 106 (FIG. 1) produces a repeating series of short duration trigger pulses, thereby permitting the photo controller 106 to operate multiple types of non-incandescent lamps with different current waveforms. For example, the photo controller 106 operates all types of incandescent and non-incandescent lamps such as compact-fluorescent or LED types.

In one embodiment, the electronic controller 120 provides a trigger pulse repetition rate within the range of about 90 to about 100 microseconds. In another embodiment, the electronic controller 120 provides a trigger pulse repetition rate within the range of about 100 to about 110 microseconds. In another embodiment, the electronic controller 120 provides a trigger pulse repetition rate within the range of about 100 to about 105 microseconds. In another embodiment, the electronic controller 120 provides a trigger pulse repetition rate within the range of about 95 to about 100 microseconds. In another embodiment, the electronic controller 120 provides a trigger pulse repetition rate of about 100 microseconds. In further embodiment, the electronic controller 120 provides a trigger pulse repetition rate within the range of about 90 to about 110 microseconds. The repeating series of trigger pulses allow a pulse to be applied at a point where current is likely to be present in the current waveforms of the various types of lamps.

In one embodiment, the electronic controller 120 provides a trigger pulse duration within the range of about 2 to about 3 microseconds. In another embodiment, the electronic controller 120 provides a trigger pulse duration within the range of about 3 to about 4 microseconds. In another embodiment, the electronic controller 120 provides a trigger pulse duration within the range of about 2.5 to about 3 microseconds. In another embodiment, the electronic controller 120 provides a trigger pulse duration within the range of about 3 to about 3.5 microseconds. In another embodiment, the electronic controller 120 provides a trigger pulse duration of about 3 microseconds. In another embodiment, the electronic controller 120 provides a trigger pulse duration within the range of about 2 to about 4 microseconds. Applying a repeating series of short duration trigger pulses assure the triggering of the AC thyristor 122 at the correct point where current is likely to be present in the current waveform while using substantially less energy than in other applications where a continuous DC trigger is used.

Figure 3:
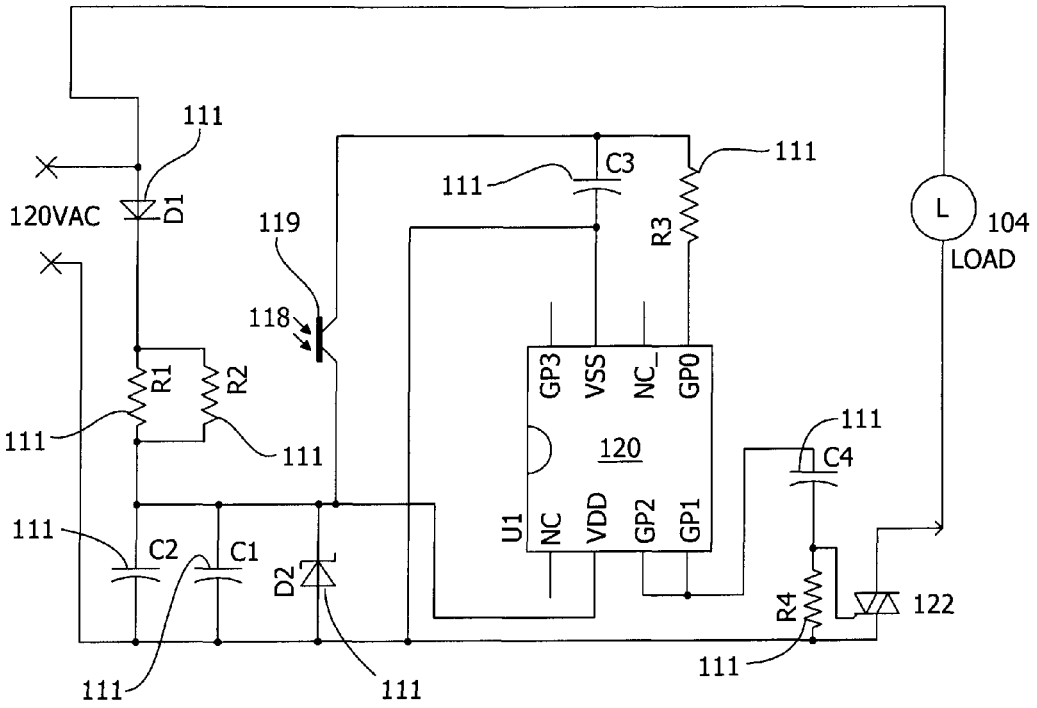
FIG. 3 is a wiring schematic layout of an exemplary photo controller assembly according to an embodiment of the present invention.

Referring to FIG. 3, in one embodiment, a wiring diagram includes suitable electronic components, such as diodes, capacitors and resistors, electrically communicating to provide a DC power supply to the photosensor 118 and to the electronic controller 120, and to filter and regulate the DC power supply. The photosensor 118 electrically communicates the level of light detected to the electronic controller 120, which responds with a series of trigger pulses electrically communicated to the AC thyristor 122. The AC thyristor 122 electrically communicates control power switching of the load or the lamp 104.

Figure 4:
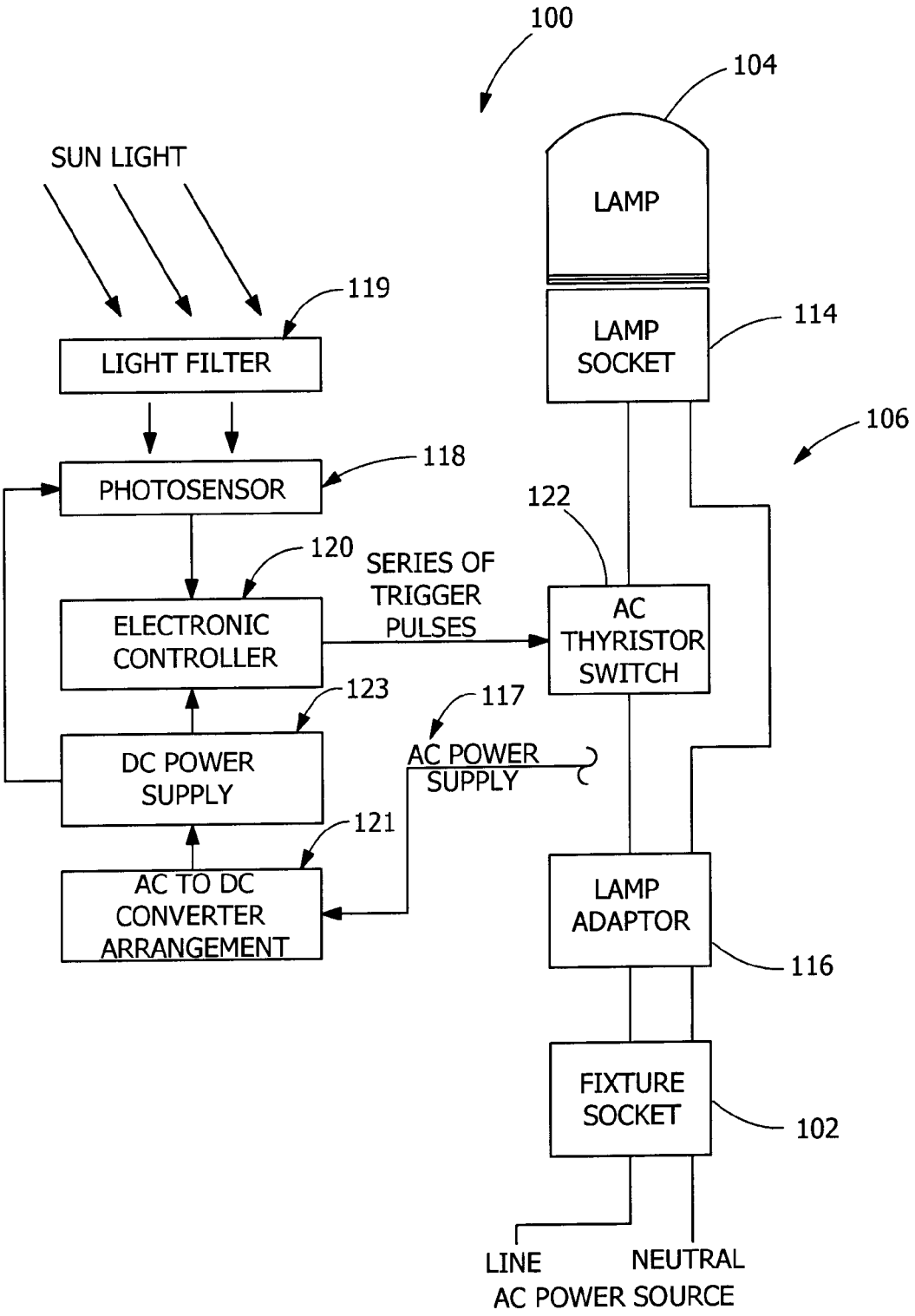
FIG. 4 is a schematic layout of an exemplary photo controller assembly according to an embodiment of the present invention.

FIG. 4 shows a schematic layout of the photo controller assembly 100 including the operation of the system according to one embodiment. Filtering of sunlight permits detection of infrared light levels by the photosensor 118. The photosensor 118 signals the light levels to the electronic controller 120, providing a series of trigger pulses to the AC thyristor 122, and switching the lamp 104. The circuit board 110 electronic components take the AC voltage of a power line (not shown) and convert it to a DC voltage which is used to power the electronic controller 120 and the photosensor 118. The photosensor 118 receives power from a DC power supply 123 that receives power from an AC power supply 117 through AC-DC converter arrangement 121.

Figure 5:
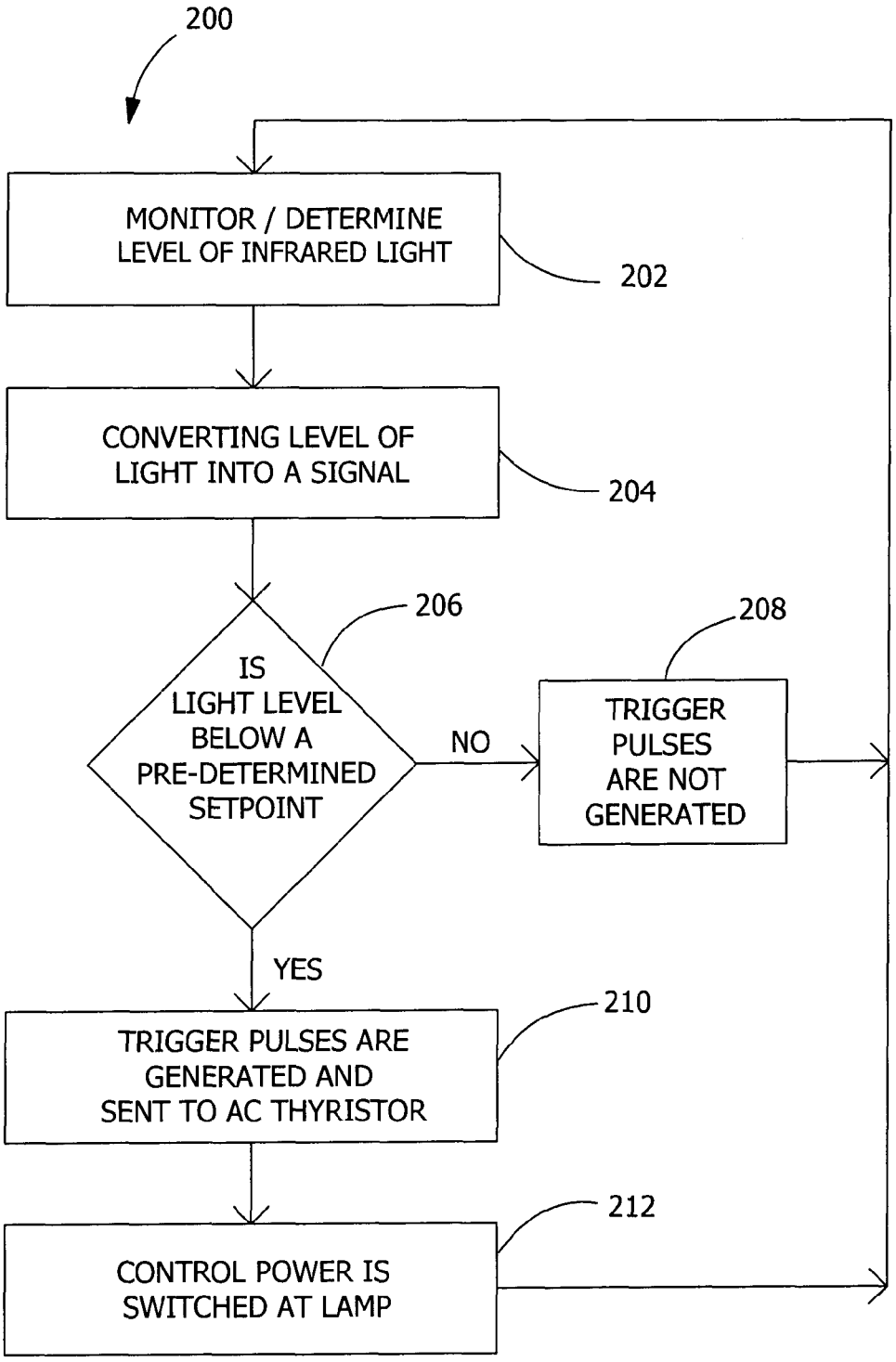
FIG. 5 is a flow chart illustrating an exemplary process of controlling non-unity power factor devices based on the light level according to an embodiment of the present invention.

Referring to FIG. 5, in one embodiment, a process 200 of controlling non-unity power factor devices includes monitoring or otherwise determining (step 202), the levels of infrared light, for example, proximate the photosensor 118, converting the monitored or determined level of light into a light level signal (step 204), and comparing the light level signal (step 206), for example, to a predetermined setpoint. If the light level is not below the predetermined setpoint, the trigger pulses are not generated (step 208). If the light level is below the predetermined setpoint, the trigger pulses are generated and sent to the AC thyristor (step 210). The control power is then switched at the lamp (step 212) using the AC thyristor. This process is repeated to appropriately control the activation of the lamp according to the level of light available at the photo controller.

Figure 6:
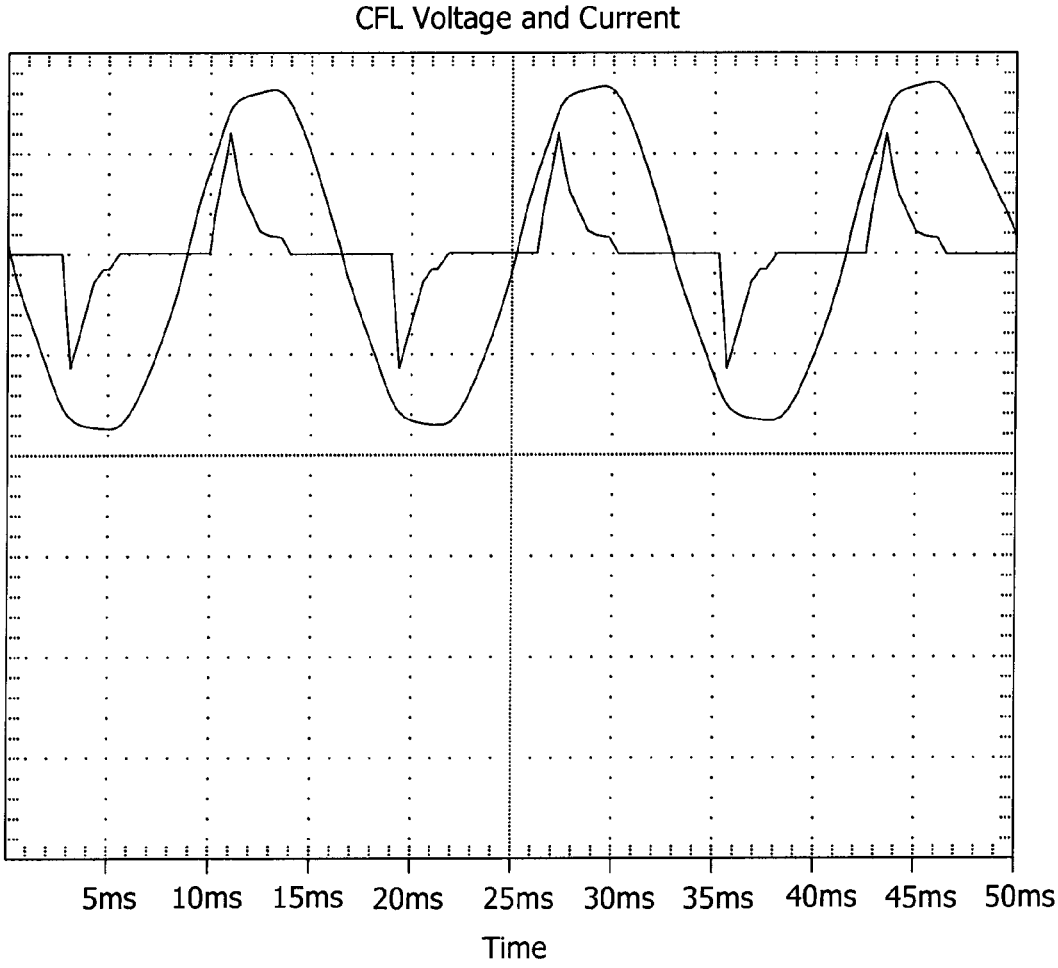
FIG. 6 is a graph illustrating exemplary voltage and current waveforms for a compact fluorescent lamp according to an embodiment of the present invention.

FIG. 6 shows a graph of voltage and current waveforms for a compact fluorescent lamp according to an embodiment. The graph illustrates the phase relationship between the voltage and current waveforms, and the harmonic distortion of the current waveform. The two waveforms are shown overlaying each other to better illustrate the locations of the zero current segments that occur before and after the voltage zero crossing points. The example current spikes shown can have different time durations and different phase relationships for different types of non-unity power factor devices.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A photo controller for controlling a non-unity power factor lamp which has voltage and distorted current waveforms out of phase, the photo controller comprising:

a housing;

a circuit board positioned within the housing;

the circuit board including a photosensor, an electronic controller and a thyristor secured to the circuit board;

wherein the electronic controller is configured to produce a series of trigger pulses during an activation period, the activation period occurring directly after a zero-cross over of the voltage due to the distortion of the current waveform which causes there to be no line current available, the series of trigger pulses activates the thyristor; and wherein the thyristor is configured to control power switching of the non-unity power factor lamp.

2. The photo controller of claim 1, wherein the housing includes a light transmitting port, a lamp socket and a lamp adaptor.

3. The photo controller of claim 2, wherein the lamp socket is configured to permit the non-unity power factor lamp to be engaged in the socket.

4. The photo controller of claim 2, wherein the lamp adaptor is configured to be inserted into the socket of a lamp fixture.

5. The photo controller of claim 1, wherein the non-unity power factor lamp includes a compact fluorescent lamp.

6. The photo controller of claim 1, wherein the non-unity power factor lamp includes a LED lamp.

7. The photo controller of claim 1, wherein the photosensor includes an infrared light filter.

8. The photo controller of claim 1, wherein the thyristor is an AC thyristor switch.

9. The photo controller of claim 1, wherein the thyristor is a bidirectional triode thyristor or bilateral triode thyristor.

10. The photo controller of claim 1, wherein the electronic controller is a microcontroller.

11. The photo controller of claim 1, wherein the repetition rate of the trigger pulses is within the range of about 90 to about 110 microseconds.

12. The photo controller of claim 1, wherein the repetition rate of the trigger pulses is within the range of about 95 to about 105 microseconds.

13. The photo controller of claim 1, wherein the repetition rate of the trigger pulses is about 100 microseconds.

14. The photo controller of claim 1, wherein the duration of the trigger pulses is within the range of about 2 to about 4 microseconds.

15. The photo controller of claim 1, wherein the duration of the trigger pulses is within the range of about 2.5 to about 3.5 microseconds.

16. The photo controller of claim 1, wherein the duration of the trigger pulses is about 3 microseconds.

17. The photo controller of claim 1, wherein the photosensor is a phototransistor.

18. A photo controller assembly for controlling a non-unity power factor lamp which has voltage and distorted current waveforms out of phase, the photo controller assembly comprising:

a fixture socket;

the non-unity power factor lamp; and a photo controller configured to releasably engage the fixture socket and the non-unity power factor lamp, the photo controller comprising:

a housing;

a circuit board positioned within the housing;

the circuit board including a photosensor, an electronic controller and an AC thyristor secured to the circuit board;

wherein the electronic controller is configured to produce a series of trigger pulses during an activation period, the activation period occurring directly after a zero-cross over of the voltage due to the distortion of the current waveform which causes there to be no line current available, the series of trigger pulses activates the AC thyristor; and wherein the AC thyristor is configured to control power switching of the non-unity power factor lamp.

19. The photo controller assembly of claim 18, wherein the series of trigger pulses has a repetition rate of about 100 microseconds and a duration of about 3 microseconds.

20. A process of controlling a non-unity power factor lamp which has voltage and distorted current waveforms out of phase, the process comprising:

providing a photo controller having an electronic controller and an AC thyristor;

determining if a setpoint for an activation period of the non-unity power factor lamp has occurred, the activation period occurring directly after a zero-cross over of the voltage due to the distortion of the current waveform which causes there to be no line current available;

producing a repeating series of trigger pulses sent by the electronic controller to the AC thyristor upon a signal dropping below the setpoint and the activation period occurring.

* * * * *